US005321595A

United States Patent [19]

Jacobi et al.

[11] Patent Number: 5,321,595

[45] Date of Patent: Jun. 14, 1994

[54] DOUBLE BULB MERCURY VAPOR LAMP APPARATUS

[75] Inventors: Lester B. Jacobi; Arthur B. Jacobi; Keith E. Brown; Daniel E. Cunningham; James B. Woodsmall, all of Marshall, Mo.

[73] Assignee: Amjo Infra Red Dryers, Inc., Marshall, Mo.

[21] Appl. No.: 940,525

[22] Filed: Sep. 4, 1992

[51] Int. Cl.[5] ..... F21V 29/00

[52] U.S. Cl. ..... 362/373; 362/6; 362/218; 362/264; 362/293; 362/294; 362/345

[58] Field of Search ..... 250/504 R; 34/1 R, 4, 34/17, 18, 88, 151, 155, 156; 362/6, 218, 264, 345, 293, 294, 373

[56] References Cited

U.S. PATENT DOCUMENTS

| | | | |
|---|---|---|---|
| 2,380,682 | 7/1945 | Boerstler | 362/293 |
| 3,914,594 | 10/1975 | Helding | 362/218 |
| 3,984,726 | 10/1976 | Ramler | 34/4 |
| 4,000,407 | 12/1976 | Keller et al. | 362/218 |
| 4,005,135 | 1/1977 | Helding | 362/218 |
| 4,685,762 | 8/1987 | Björnberg | 250/504 R |
| 4,890,208 | 12/1989 | Izenour | 362/294 |
| 4,948,980 | 8/1990 | Wedekamp | 250/504 R |

FOREIGN PATENT DOCUMENTS

| | | | |
|---|---|---|---|
| 0699124 | 12/1964 | Canada | 362/294 |
| 0409757 | 1/1991 | European Pat. Off. | 362/294 |

*Primary Examiner*—Ira S. Lazarus
*Assistant Examiner*—Alan B. Cariaso
*Attorney, Agent, or Firm*—Litman, McMahon & Brown

[57] ABSTRACT

A two bulb mercury vapor lamp apparatus includes a housing with a bottom whose cross-section forms a curved "M" shape. A pair of reflectors are attached to the bottom of the housing with each reflector positioned in one-half of the "m". The reflectors direct light from the bulbs onto a focal plane where a photosensitive material is located. A plurality of quartz liquid coolant circulating tubes are positioned between the bulbs and the photosensitive material which tubes both cool the lamp and filter out infrared rays. The coolant tubes are attached to a pair of end blocks which are removably secured to the housing. The end blocks, connected plumbing lines and coolant tubes can be lowered from the housing intact, thus greatly facilitating maintenance access to the bulbs and reflectors.

18 Claims, 1 Drawing Sheet

DOUBLE BULB MERCURY VAPOR LAMP APPARATUS

BACKGROUND OF THE INVENTION

The present invention relates to a double bulb mercury vapor lamp apparatus including cooling and infrared filtering systems.

In photodevelopment applications, lamps are used to cure photosensitive materials such as inks, paints and coatings. In modern web or sheet presses, extremely high speeds of operation require the use of high intensity light sources to provide the requisite rapid curing of photosensitive materials during very short exposure times. Mercury vapor lamps are often used to provide the required high intensity light. However, the use of mercury vapor lamps introduces a number of problems.

Mercury vapor lamps must operate at temperatures exceeding the boiling point of mercury, i.e. 450 degrees Celsius, but below the devitrification temperature of the lamp envelope. Thus, these lamps are generally placed in quartz envelopes. When they are used as lamps for photosensitive applications, the high temperatures generated by the bulbs require elaborate cooling systems to prevent the materials being cured from being damaged by the heat. At the same time, the considerable infrared radiation given off by mercury vapor bulbs can provide unwanted heating of the curing materials as well.

These problems were addressed in U.S. Pat. No. 4,000,407 ('407 patent), which is incorporated herein by reference. In the '407 patent, a quartz envelope mercury vapor bulb is positioned in a reflector housing with water circulated through the housing as a cooling agent. The bulb is positioned within an arc-shaped reflector which directs light from the bulb toward the material being cured. Positioned between the bulb and the curing material are a pair of transparent tubes, which may be made of quartz as well. Water or another transparent cooling medium is circulated through the tubes to provide additional cooling and to act as a filter for infrared radiation generated by the bulb. Thus, the curing material is protected from direct heat generated by the bulb and from indirect heating due to the infrared radiation emitted by the bulb.

While this arrangement has proven to be generally satisfactory, speed advancements in the printing art since the '407 patent issued have necessitated the use of stronger radiation sources with consequent increased cooling requirements, but confined within a housing of comparable size.

It is clear then, that a need exists for an improved mercury vapor lamp apparatus with infrared filtering and cooling systems which can produce enhanced illumination in a photosensitive application without damaging the materials to be cured. Such a lamp must provide the enhanced illumination without producing temperatures or infrared radiation which can damage the curing materials, and must be contained within a housing of comparable size to ones in prior art single bulb lamps.

SUMMARY OF THE INVENTION

The present invention is a two bulb mercury vapor lamp apparatus including an infrared filter and cooling system for use as an illumination source in photosensitive applications or the like. The apparatus comprises an elongate housing accommodating two mercury vapor bulbs, each positioned within a separate reflector. The two reflectors are attached to the bottom of the housing with their cross-sections forming a curved "M" configuration. Each reflector forms one half of the "M" and is adapted to reflect and focus light from its respective bulb toward a focal plane positioned below the housing on which is located a web or sheet of curing photosensitive material.

Four hollow areas extend the length of the housing for circulating cooling fluid. In addition, two pairs of cooling tubes, preferably made out of quartz, are positioned between the bulbs and the curing material, with each pair of cooling tubes being connected together at one end by a coolant return block. The other ends of each tube connect with openings in a coolant supply block with one tube in each pair connected to a supply source of cooling fluid, such as deionized water, while the second cooling tube in each pair acts as a return for the cooling fluid. Both supply blocks are removably attached to the lamp housing so that the blocks can be removed with the connected cooling tubes intact to provide ready access to the mercury vapor bulbs for replacement or maintenance. Each reflector contains a number of perforations which communicate with a corresponding compressed air supply pipe positioned within the housing. Thus, additional cooling can be provided by circulating compressed air through the perforations in the reflectors via the air supply pipes. The resulting lamp arrangement is an improvement over the configuration taught in the '407 patent, greatly increasing the illumination produced and facilitating maintenance. A lamp fixture in accordance with the present invention actually provides greater usable illumination than would a pair of the prior art fixtures.

OBJECTS AND ADVANTAGES OF THE INVENTION

The principle objects of the invention are: to provide an improved mercury vapor lamp apparatus with infrared filtering and cooling systems for use in photosensitive applications or the like; to provide such an apparatus in which a pair of high intensity mercury vapor bulbs are positioned within respective reflectors in a single housing; to provide such an apparatus in which a number of cooling tubes are positioned between the bulbs and photosensitive material to be cured, the cooling tubes providing simultaneous cooling and infrared filtering; to provide such an apparatus in which the cooling tubes are attached to the housing via a pair of removable blocks which facilitate ready access to the bulbs for maintenance and/or replacement; to provide such an apparatus in which additional cooling is provided by circulating liquid through elongate hollow portions of the housing and air through perforations in the reflectors; to provide such an apparatus in which greatly increased illumination is obtained; and to provide such an apparatus which is particularly well suited for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figures 1, 2, 3:
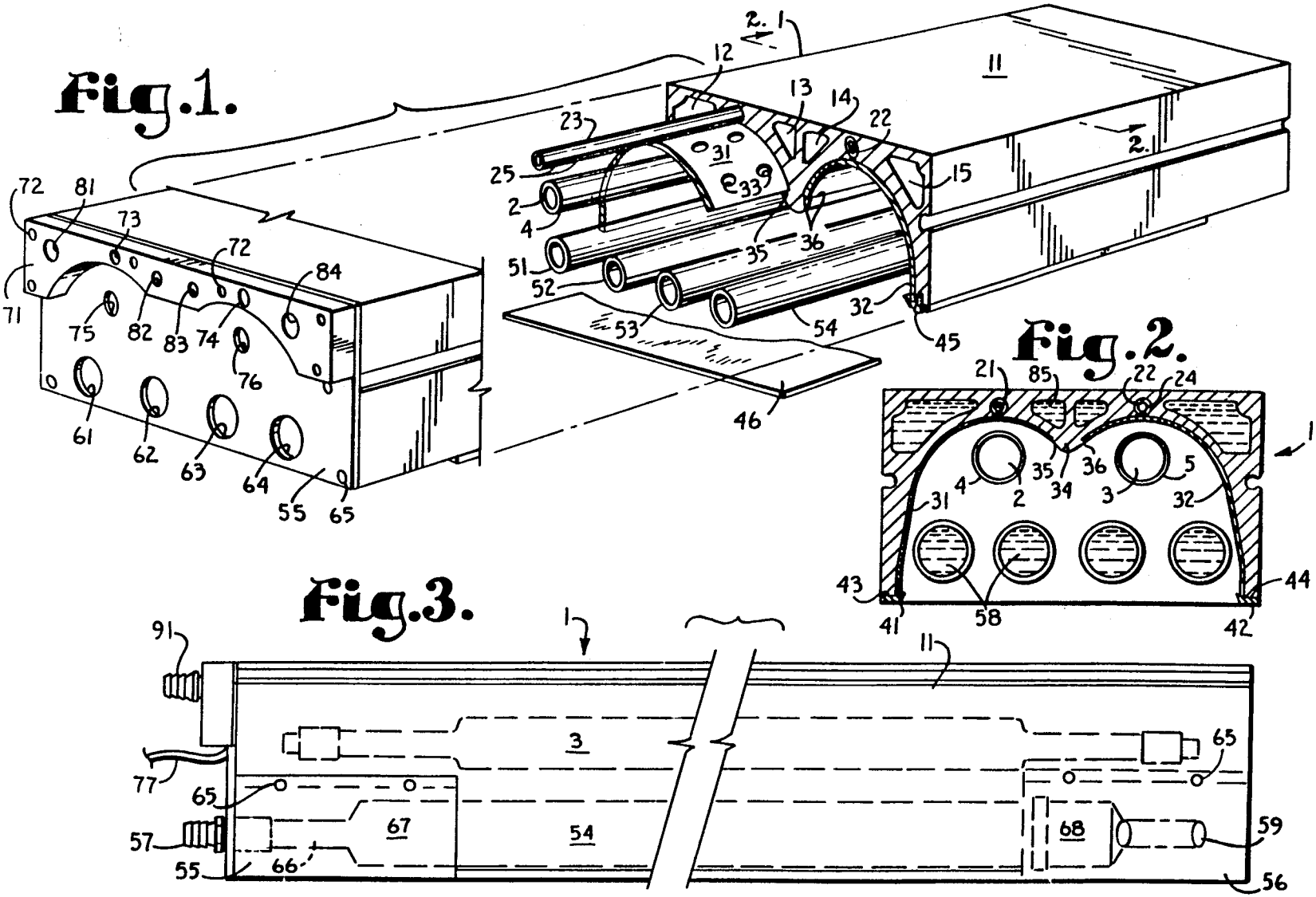
FIG. 1 is a perspective view of a double bulb mercury vapor lamp apparatus in accordance with the invention with portions broken away to show detail thereof.
FIG. 2 is a cross-sectional view of the lamp, taken along line 2—2 of FIG. 1.
FIG. 3 is a side elevational view of the lamp, with internal elements illustrated in phantom lines.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIGS. 1-3, a double bulb mercury vapor lamp is generally indicated as 1. The lamp 1 includes a pair of mercury vapor bulbs 2 and 3, encased in quartz envelopes 4 and 5, respectively. A housing 11, which is preferably constructed of a single piece casting, comprises a plurality of liquid coolant circulating hollow sections 12-15 extending the length of the housing 11 and a pair of elongate apertures 21 and 22 which accommodate a corresponding pair of air circulating tubes 23 and 24, each of which includes a plurality of perforations 25 along the bottom thereof. The hollow apertures 12 and 15, and 13 and 14, respectively, are interconnected at the far end in FIG. 1 (interconnections not shown) within the housing 11. A pair of reflectors 31 and 32 are placed on the bottom of the housing 11. Each of the reflectors includes a plurality of perforations 33 for circulating air from the tubes 23 and 24. A cross-section of the bottom of the housing II forms a curved "M" which includes a center protrusion 34. The protrusion 34 extends along the entire length of the housing and has a pair of lips 35 and 36 running lengthwise thereof for accommodating one edge of the reflectors 31 and 32, respectively. Each reflector 31 and 32 is sized and shaped to fit the bottom of the housing 11, with each reflector forming one half of the "M" shape. Once the edges of the reflectors 31 and 32 are seated within the lips 35 and 36, a pair of reflector securing channels 41 and 42, are secured to bottom edges 43 and 44 of the housing II, respectively, by screws 45. Thus, each reflector 31 and 32 is held securely in place by the combination of the lips 35 and 36 and the channels 41 and 42. The reflectors 31 and 32 are positioned and configured in a manner to reflect and concentrate light from the bulbs 2 and 3 onto a focal plane on which is positioned material 46 to expose photosensitive print or coatings thereon.

A plurality of liquid coolant tubes 51-54, which are constructed of a material with a high devitrification temperature, such as quartz, extend beneath the bulbs 2 and 3. The tubes 51-54 are secured in place via a pair of end blocks 55 and 56. The end block 55 is a coolant supply block while the block 56 is a coolant return block. The end block 55 has four apertures 61-64 sized and positioned to accommodate plumbing connectors 57 for connecting sources and returns for cooling fluid 58. The apertures 61-64 connect into a plurality of relatively narrow neck portions, one of which is shown at 66 in FIG. 3. The narrow neck portions 66 then widen into enlarged collar portions 67 which are adapted to receive the ends of the respective tubes 51-54. The return block 56 has a matching plurality of enlarged collar portions 68 which are adapted to receive the other ends of the tubes 51-54. A pair of internal connections 59 each connect a pair of the collar portions 68 to each other, thus connecting tube 51 to tube 52 and tube 53 to tube 54. Each end block 55 and 56 is removably secured to the housing 11 via a plurality of screws 65. A coolant connection plate 71 is secured to one end of the housing 11 via a plurality of screws 72. The plate 71 has a pair of compressed air connection apertures 73 and 74 which connect with the tubes 23 and 24, respectively, and with a source of compressed air (not shown). The plate 71 also includes four fluid coolant connection apertures 81-84, which connect liquid coolant 85 via four coolant plumbing supply and return connectors 91 to the hollow coolant apertures 12-15, respectively. A pair of openings 75 and 76 are provided in the end of the housing 11 for electrical supply cables 77 which supply power to the bulbs 2 and 3.

The operation of the lamp 1 will now be described, again with reference to FIGS. 1-3. The lamp 1 is positioned within a photosensitive printing press or the like (not shown) in which a web of material 46 is partially coated with photosensitive ink or the like. In such presses, the material web 46 moves at considerable speed so that the ink must be cured by exposure to strong light rays from the lamp 1. Within the lamp 1, the bulbs 2 and 3 are powered by electrical cables 77, thus emitting strong light rays and considerable heat as well, both convective and radiant via infrared rays. Thus the lamp 1 must be cooled to prevent heat damage to the material 46. To accomplish this, the liquid coolant 85, which can comprise ordinary tap water, is circulated through the hollow apertures 12-15 in the housing 11, and compressed air is blown throughout the housing 11 via tubes 23 and 24 and the perforations 33 in the reflectors 31 and 32. Furthermore, additional cooling liquid 58, such as deionized water, is circulated through the quartz tubes 51-54. The quartz tubes 51-54 and cooling water 58 also act as filters, preventing significant amounts of infrared radiation from reaching the material 46. The "M" shape of the bottom of the housing 11 and the reflectors 31 and 32 acts to reflect and concentrate light from the bulbs 2 and 3 onto a focal plane on which is placed the material 46.

In a significant departure from the prior art, the end blocks 55 and 56 and the connected coolant tubes 51-54 can be removed from the housing 11 simply by loosening the screws 65 and lowering the end blocks 55 and 56 away from the housing 11. This allows the tubes 51-54 and the plumbing connections 57 to remain intact when the bulbs 2 and 3 and/or the reflectors 31 and 32 require maintenance. This results in a great reduction in the time and labor needed to service the lamp 1.

It is to be understood that while certain forms of the present invention have been illustrated and described herein, it is not to be limited to the specific forms or element of parts described and shown.

What is claimed and desired to be secured by Letters Patent is as follows:

1. An apparatus for directing and focusing light from a pair of high intensity light sources, comprising:

(a) a housing with a pair of reflectors collectively forming a curved "M" shape in cross-section being attached thereto, with one light source positioned within each reflector;

(b) a plurality of transparent coolant circulating tubes positioned between the light sources and a focal plane of said reflectors, said tubes having circulated therethrough a light filtering fluid which filters a selected spectrum portion of said light from said sources to said focal plane;

(c) said housing comprising a center protuberance forming the center of said "M" shape, said protuberance including a pair of lips adapted to receive respective ends of said reflectors, said housing including bottom ledges which form the ends of said "M" shape; and (d) said reflectors are attached to said housing by inserting one end of each reflector into a respective one of said lips and securing the other end of each said reflector via a reflector retaining channel which is removably secured to a respective one of said housing bottom ledges.

2. An apparatus as in claim 1, wherein said focal plane is coincident with a photosensitive material to be cured, and wherein:

(a) said coolant circulating tubes filter out infrared radiation from said light sources.

3. An apparatus as in claim 2, wherein:

(a) said light sources comprise mercury vapor bulbs.

4. An apparatus as in claim 2, wherein:

(a) said reflectors are attached to the bottom of said housing, a cross-section of which forms said "M" shape; and (b) said coolant circulating tubes are connected to a pair of end blocks which are adapted to be removably connected to said housing.

5. An apparatus as in claim 4, wherein:

(a) said housing comprises a plurality of elongate hollow portions adapted for circulating liquid coolant through said housing.

6. An apparatus as in claim 5, wherein:

(a) ordinary tap water is circulated through said hollow portions as said cooling fluid, while deionized water is circulated through said cooling tubes.

7. An apparatus as in claim 5, wherein:

(a) said end blocks and said cooling tubes can be lowered intact from said housing to facilitate maintenance of said light sources and said reflectors.

8. An apparatus for directing and focusing light from a pair of high intensity mercury vapor bulbs, comprising:

(a) a housing comprising a plurality of elongate hollow portions adapted for circulating liquid coolant through said housing, with a portion of a cross-section of said housing forming a curved "M" shape;

(b) a pair of reflectors attached to said housing with each said reflector forming one half of said "M" shape, with one of said bulbs positioned within each reflector, said pair of reflectors focusing said light onto a focal plane which is coincident with a photosensitive material to be cured;

(c) a plurality of transparent coolant circulating tubes positioned between the bulbs and said focal plane of said reflectors, each tube comprising two ends; and wherein (d) the ends of said coolant circulating tubes are connected to a respective pair of end blocks which are adapted to be removably connected to said housing, said tubes having circulated therethrough a light filtering fluid which filters a selected spectrum portion of said light from said bulbs to said focal plane.

9. An apparatus as in claim 8, wherein:

(a) said housing comprises a center protuberance forming the center of said "M" shape, said protuberance including a pair of lips adapted to receive respective ends of said reflectors, said housing including bottom ledges which form the ends of said "M" shape; and (b) said reflectors are attached to said housing by inserting one end of each reflector into a respective one of said lips and securing the other end of each said reflector via a reflector retaining channel which is removably secured to a respective one of said housing bottom ledges.

10. An apparatus as in claim 8, wherein:

(a) said end blocks and said cooling tubes can be lowered intact from said housing to facilitate maintenance of said light sources and said reflectors.

11. An apparatus as in claim 8, wherein:

(a) said housing comprises a plurality of elongate apertures which accommodate corresponding perforated air circulating tubes for additional cooling.

12. An apparatus as in claim 8, wherein:

(a) ordinary tap water is circulated through said hollow portions as said liquid coolant, while deionized water is circulated through said coolant circulating tubes.

13. An apparatus for directing and focusing light from a pair of high intensity light sources and comprising:

(a) a pair of reflectors forming a curved "M" shape in cross-section, with one light source positioned within each reflector;

(b) a plurality of coolant circulating tubes positioned between the light sources and a focal plane of said reflectors;

(c) said focal plane being coincident with a photosensitive material to be cured and said coolant circulating tubs also filtering out infrared radiation from said light sources;

(d) said housing including a center protuberance forming the center of said "M" shape, said protuberance including a pair of lips adapted to receive respective ends of said reflectors, said housing including bottom ledges which form the ends of said "M" shape;

(e) said reflectors being attached to said housing by inserting one end of each reflector into a respective one of said lips and securing the other end of each said reflector via a reflector retaining channel which is removably secured to a respective one of said housing bottom ledges;

(f) said housing including a plurality of elongate hollow portions adapted for circulating liquid coolant through said housing; and (g) said housing including a plurality of elongate apertures which accommodate corresponding perforated compressed air circulating tubes for additional cooling.

14. An apparatus as in claim 13, wherein:

(a) said reflectors each include a plurality of reflector perforations; and (b) the perforations in said air circulating tubes feed air into said housing above said reflectors, which, in turn feed air through said reflector perforations onto said light sources.

15. An apparatus for directing and focusing light from a pair of high intensity mercury vapor bulbs and comprising:

(a) a housing including a plurality of elongate hollow portions adapted for circulating liquid coolant through said housing, with a portion of a cross-section of said housing forming a curved "M" shape;

(b) a pair of reflectors attached to said housing with each said reflector forming one half of said "M" shape, with one of said bulbs positioned within each reflector, said pair of reflectors focusing said light onto a focal plane which is coincident with a photosensitive material to be cured;

(c) a plurality of coolant circulating tubes positioned between the light sources and said focal pane of said reflectors, each tube comprising two ends and the ends of said coolant circulating tubes being connected to a respective pair of end blocks which are adapted to be removably connected to said housing;

(d) said housing including a plurality of elongate apertures which accommodate corresponding perforated air circulating tubes are additional cooling;

(e) said reflectors each including a plurality of reflector perforations; and (f) the perforations in said air circulating tubes feeding air into said housing above said reflectors, which, in turn feed air through said reflector perforations onto said bulbs.

16. In an apparatus for focusing light from elongated light source means toward a focal plane and including an elongated housing; elongated reflector means positioned within said housing; said light source means being connected to said housing and positioned within said reflector means to focus light toward said focal plane; and elongated, transparent coolant tube means positioned between said light source means and said focal plane and having a light filtering liquid circulating therethrough, the improvement comprising:

(a) end blocks releasably connected to said housing;

(b) said coolant tube means having opposite ends connected to said end blocks to enable intact removal of said end blocks with said tube means, for access to said light source means;

(c) said housing including a plurality of passages formed therethrough for the circulation of a liquid coolant.

17. An apparatus as set forth in claim 16 wherein:

(a) said reflector means is an elongated double reflector having a pair of elongated reflectors joined to form a cross-section in the shape of a curved "M"; and (b) said light source means includes a respective elongated bulb positioned in each of said reflectors to focus light from said bulb toward said focal plane.

18. In an apparatus for focusing light from elongated light source means toward a focal plane and including an elongated housing; elongated reflector means positioned within said housing; said light source means being connected to said housing and positioned within said reflector means to focus light toward said focal plane; and elongated, transparent coolant tube means positioned between said light source means and said focal plane and having a light filtering liquid circulating therethrough, the improvement comprising:

(a) end blocks releasably connected to said housing;

(b) said coolant tube means having opposite ends connected to said end blocks to enable intact removal of said end blocks with said tube means, for access to said light source means;

(c) said housing including an elongated aperture means in which perforated air circulating tube means are positioned including a plurality of air perforations;

(d) said reflector means including a plurality of reflector perforations; and wherein (e) said air perforations communicate air through said reflector perforations to said light source means to cool same.

* * * * *